US006225271B1

(12) United States Patent
Wright, Jr. et al.

(10) Patent No.: US 6,225,271 B1
(45) Date of Patent: May 1, 2001

(54) BLACK POWDER GUN BARREL BORE, CARTRIDGE, AND PARTS CLEANING SOLUTION

(75) Inventors: Melvin Wright, Jr., Turner Station; John H. Hoffman, Pleasureville, both of KY (US)

(73) Assignee: Hoffman & Wright LLC, Pleasureville, KY (US)

( * ) Notice: Subject to any disclaimer, the term of this patent is extended or adjusted under 35 U.S.C. 154(b) by 0 days.

(21) Appl. No.: 09/410,953

(22) Filed: Oct. 5, 1999

(30) Foreign Application Priority Data

Oct. 6, 1998 (CA) ..... 2249721

(51) Int. Cl.[7] ..... C11D 77/04
(52) U.S. Cl. ..... 510/190
(58) Field of Search ..... 510/190

(56) References Cited

U.S. PATENT DOCUMENTS 919,884 * 4/1909 Klever ..... 510/190
1,484,690 * 2/1924 Walker et al. ..... 510/190
1,719,933 7/1929 Huff .
2,948,685 8/1960 Fisher .
4,806,274 * 2/1989 Crouse et al. ..... 252/548
5,490,947 2/1996 Cioffe .
5,824,631 * 10/1998 Wagenknecht et al. ..... 510/254
5,935,918 * 8/1999 Pomp ..... 510/190

* cited by examiner

*Primary Examiner*—Yogendra Gupta
*Assistant Examiner*—John M Petruncio
(74) *Attorney, Agent, or Firm*—Carrithers Law Office; David W. Carrithers

(57) ABSTRACT

This invention relates to a cleaning and lubricating solution for guns, gun bores, cartridges, and gun parts, and more especially for black powder guns, gun bores, cartridges, and gun parts. The solution is used to clean dirt and debris from the bores and other parts of black powder firearms and accessories. The solution cleans the bore and the residual material forms a protective coating or film of a light lubricating oil.

2 Claims, No Drawings

BLACK POWDER GUN BARREL BORE, CARTRIDGE, AND PARTS CLEANING SOLUTION

BACKGROUND OF THE INVENTION

1. Technical Field

This invention relates to a cleaning and lubricating solution for guns, gun bores, cartridges, and gun parts, and more especially for black powder guns, gun bores, cartridges, and gun parts.

The present invention comprises a cleaning and lubricating solution containing a fatty acid compound such as an oleate, an oxidizing agent preferably hydrogen peroxide solution, and an alcohol. A bittering agent is generally included, but is not essential to the performance of the cleaning and lubricating solution.

Unlike modern firearms, black powder firearms are not blued or chromed in that the black powder, ("also known as blasting powder"), contains a brown or black explosive mixture of potassium nitrate, charcoal, and sulfur which is corrosive to such a finish. In some cases, sodium nitrate is substituted for potassium nitrate. Typical proportions are 75%, 15%, and 10%, respectively. Originally gun powder was made in powder form, whereas today it is formed into grains of various sizes. It is sensitive to heat and deflagrates rapidly. It does not detonate, but is a dangerous fire and explosion hazard. Besides gunpowder, black powder is still used for time fuses for blasting, in large caliber artillery shells, in igniter and primer assemblies for propellants, pyrotechnics, and mining.

2. Description of the Prior Art

Due to the corrosive chemical nature of black powder on steel, black powder guns must be cleaned immediately upon use, and may rust in less than two hours within use. Black powder guns, whether inline, caplock, flintlock, or large caliber military guns need to be cleaned after every shot or two to maintain good accuracy. Because of the corrosiveness of black powder cleaning is very important in protecting an investment in these weapons.

Conventional methods of cleaning black powder guns consisted of filling the barrel with hot soapy water and swapping a patch back and forth through the barrel bore until the patch was white indicating the barrel bore was clean. Typically the gun barrel and bore was lubricated with a light oil to prevent rust.

Furthermore, black powder weapons accumulate a seasoning over time like an "iron skillet". Conventional petroleum-based cleaners now on the market tend to strip all of that seasoning out of the gun barrel bore leaving the weapon vulnerable to rust in that it strips the protective patina from the metal.

SUMMARY OF THE INVENTION

The present invention is used to clean dirt and debris from the bores and other parts of black powder firearms and accessories. The solution cleans the bore and coats it with a lubricant comprising an oil such as a GRAS vegetable oil. The solution is safe for use with modern firearms, whether nickel plated, blued, or stainless steel, as well as carbon steel antique weapons, and is considered to be an "environmentally-friendly" product.

The cleaning and lubricating solution of the present invention may be used straight from the container and poured into a gun barrel bore, or even onto the metal surface of the gun. Moreover, the cleaning and lubricating solution may be incorporated into gun oil, pre-lubricated muzzle loader patches, bore conditioners, and or bullet lubricants.

It is an object of the present invention to provide an inexpensive cleaning and lubricating solution which may be used for black powder guns in a single step so that the treated gun bore is cleaned and a lubricant film is formed upon draining from the barrel.

It is another object of the present invention to provide a cleaning and lubricating solution for black powder guns which is environmentally friendly and generally recognized as safe for the user.

It is another object of the present invention to be able to use the cleaning and lubricating solution in a short time span.

It is another object of the present invention to provide a solution which may be applied by brush, spray, dipping, and/or swabbing.

It is another object of the present invention to provide a cleaning solution which will not harm the lubrication seasoning in the bore.

It is another object of the present invention to provide a cleaning and lubricating solution which is compatible with existing gun oils and lubricants.

It is another object of the present invention to provide a cleaning and lubricating solution which exhibits a foaming action thereby providing a self cleaning lubricant which penetrates into the cracks and crevices of the metal to clean and lubricate.

It is another object of the present invention to provide a cleaning and lubricating solution which acts to passivate the metal.

It is yet another object of the present invention to provide a cleaning and lubricating solution for black powder applications wherein the amount of fouling in the bore make no difference.

Finally, it is an object of the present invention to provide a solution which may be used to wipe off the metal around the lock to prevent corrosion.

The foregoing objects are accomplished by the cleaning and lubricating solution of the present invention.

Preferred compositions of the black powder cleaning and lubricating solution typically contain a hydrogen peroxide solution in an amount ranging from about 15 percent to about 50 percent by weight of the total weight percent of the composition based on a 4% solution; an alcohol in an amount ranging from about 15 percent to about 50 percent by weight of the total weight percent of the composition; and a fatty acid soap in an amount ranging from about 15 percent to 60 percent by weight of the total weight percent of the composition. One preferred embodiment comprises about one-third of a fatty acid, about one-third of an alcohol, and about one-third of a 4% hydrogen peroxide solution. One or more bittering agents may be utilized with the above aforementioned ingredients.

DESCRIPTION OF THE PREFERRED EMBODIMENT

The cleaning and lubricating solution of the present invention is formulated to provide a single use solution for use in storage or in the field. However, it is contemplated that the solution may be combined with existing lubricants, cleaners and oils to enhance the performance characteristics especially demonstrated by the deep cleaning foaming action of the solution. Moreover, the formulation may be adjusted to provide more cleansing or lubricating advantages as desired.

As set forth heretofore, the preferred compositions of the black powder cleaning and lubricating solution typically contain a hydrogen peroxide solution in an amount ranging from about 15 percent to about 50 percent by weight of the total weight percent of the composition based on a 4% solution; an alcohol in an amount ranging from about 15 percent to about 50 percent by weight of the total weight percent of the composition; and a fatty acid soap in an amount ranging from about 15 percent to 60 percent by weight of the total weight percent of the composition. One preferred embodiment comprises about one-third of a fatty acid, about one-third of an alcohol, and about one-third of a 4% hydrogen peroxide solution. One or more bittering agents may be utilized with the above aforementioned ingredients. The individual components of the solution are set forth in more detail as follows:

Fatty Acid Lubricant

Natural occurring vegetable oil such as corn oil, sunflower oil, olive oil, soybean oil, peanut oil, or other such naturally occurring oil may be utilized in the present invention as well as a potassium hydroxide based soap. The fatty acid is preferably non-volatile, non-corrosive oil of a relatively low viscosity providing a light film residue which blends with readily with oils or greases which may be subsequently applied to protect the bore surface.

A preferred fatty acid of the present invention is a carboxylic acid derived from or contained in an animal or vegetable fat or oil. It is composed of a chain of alkyl groups containing from 4 to 22 carbon atoms characterized by a terminal carboxyl group —COOH. The generic formula for all above acetic is $CH_3(CH_2)_xCOOH$, wherein the carbon atom count includes the carboxyl group.

The preferred fatty acid is an unsaturated fatty acid in which there are one or more double bonds between the carbon atoms in the alkyl chain. These acids are usually vegetable-derived and consist of alkyl chains containing 18 or more carbon atoms with the characteristic end group —COOH. Most vegetable oils are mixtures of several fatty acids or their glycerides. The most common unsaturated acids are oleic, linoleic, and linolenic (all $C_{18}$ Safflower oil is high in linoleic acid, peanut oil contains 21% linoleic acid, olive oil is 38% oleic acid.

Soaps such as sodium, potassium, and ammonium salts of oleic and stearic acids are particularly preferred fatty acid soaps.

More particularly, oleic acid, (cis-9-octadecenoic acid), defined as $CH_3(CH_2)_7CH{:}CH(CH_2)_7COOH$, is a monounsaturated fatty acid which is a component of almost all natural fats as well as tall oil. Most oleic acid is derived from animal tallow or vegetable oils. The fatty acid group is typically formed by saponification of oleic acid provides a neutralized soap completely miscible with water, and biodegradable. The preferred embodiment utilizes fatty acid soaps selected from the oleic acid group, preferably potassium oleate, ($C_{17}H_{33}COOK$), and/or ammonium oleates ($C_{17}H_{33}COONH_4$). The oleic acid component of the present invention is insoluble in water, but soluble in alcohol and is a solvent for other oils, fatty acids and oil-soluble materials. It is also contemplated that olein, (glyceryl trioleate), the triglyceride of oleic acid occurring most fats and oils may also be used in place of or in combination with other fatty acids. It constitutes from about 70 to about 80 percent of olive oil.

The present invention incorporates a fatty acid, such as a vegetable oil or oleic acid compound in an amount ranging from about 10 percent to about 50 percent by volume, more preferably from about 20 to about 40 percent by volume; and most preferably about 30 percent by volume.

Alcohols

Alcohols which may be used in the present invention comprise a broad class of hydroxyl-containing organic compounds occurring naturally in plants and made synthetically from petroleum derivatives such as ethylene. These include: I Monohydric (10H group) such as 1) aliphatic including paraffinic (ethanol) and olefinic (allyl alcohol), 2) alicyclic (cyclohexanol), 3) aromatic (phenol, benzyl alcohol), 4) heterocyclic (furfuryl alcohol) and 5) poly cyclic (sterols); II dihydric (2OH groups) such as glycols and derivatives (diols); and III trihydric (3 OH groups) such as glycerol and derivatives.

The most preferred alcohol is isopropyl alcohol, $(CH_3)_2CH_2O$ which is a colorless liquid, soluble in water. Other alcohols which may be used in the present invention include ethyl, and butyl alcohol. It is contemplated that water-soluble alcohols containing from 1 to about 4 carbon atoms and 1 to about 3 hydroxy groups may be used including the glycols or glycol ethers and monoethers such as the methyl, ethyl, propyl, and butyl ethers of ethylene glycol; diethylene glycol, propylene glycol, and dipropylene glycol.

The present invention incorporates an alcohol, such as isopropyl alcohol in an amount ranging from about 5 percent to about 50 percent by volume, more preferably from about 15 to about 40 percent by volume; more preferably from about 25 to about 35 percent by volume; and most preferably about 30 percent by volume.

Oxidizing Agents

The present invention utilizes an oxidizing agent which is a compound that spontaneously evolves oxygen either at room temperature or under slight heating. The oxidizing agents which may be used in the present invention include chemicals such as peroxides, chlorates, percholrates, nitrates, and permanganates.

The preferred oxidizing agent for the instant invention is hydrogen peroxide having a molecular formula of $H_2O_2$ and a structural formula of H—O—O—H. It is soluble in both water an alcohol. It is a very strong oxidizing agent and concentrated solutions are highly toxic; therefor, a very weak solution of 4% is utilized in the preferred embodiment of the present invention. Solutions ranging from 0.1 to 10% may be used depending upon the desired characteristics of the solution.

It is believed that the oxidizing agent serves to passivate the metal of the gun bore in that the metals within the bore lose their normal chemical activity in a corrosive environment after treatment with a strong oxidizing agent such as the nitric acid produced by ignition of black powder. Treatment with the oxidizing agent of the present invention provides oxygen thereby forming an oxide coating and protecting the seasoning of the metal.

The present invention incorporates an oxidizing agent, such as 0.1 to 10.0 percent and more preferably from 2.0 to 4.0 percent strength solution of hydrogen peroxide in an amount ranging from about 0.1 percent to about 60 percent by volume, more preferably from about 1 to about 50 percent by volume; more preferably from about 10 to about 40 percent by volume; more preferably from about 20 to 35 percent by volume and most preferably about 30 percent by volume.

Bittering Agents

A bittering agent may be added to the formulation in an amount of less than 5% and usually in an amount ranging from about 0.1 to 1.0 percent. Bitrex also known as denatonium benzoate may be used and/or benzylidiethyl.

METHOD OF USE

For example, to clean a black powder gun barrel bore, with the cleaning and lubricating solution of the present invention, simply plug the nipple or flash vent hole with an object, even a toothpick.

For field cleaning, run a patch dampened with the cleaning and lubricating solution of the present invention through the bore several times. After removing the plug, run a dry patch through the bore.

For final cleaning, plug and pour the cleaning and lubricating solution into the bore to within about two inches of the muzzle. Let the gun stand upright for approximately ten minutes. Pour the cleaning and lubricating solution from the barrel bore and run a dry patch therethrough. The bore will not only be clean but have a thin coat of lubricant thereon. Of course in saltwater or humid conditions it is recommended to apply a fine coat of oil to the bore. A light oil or other lubricant may be used in combination with or in addition to the present composition after cleaning to further remove any neutralized residue and supplement the protective coating formed by the present invention.

It should be noted that upon pouring the solution into the barrel bore, the solution will fizzle and bubble as it reacts with the gunpowder residue neutralizing same. The solution poured from the barrel will generally remain clear as before use. After several applications the solution will cease to bubble and adopt a gray tint or cast indicating the effectiveness is gone.

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

Reference to documents made in the specification is intended to result in such patents or literature cited are expressly incorporated herein by reference, including any patents or other literature references cited within such documents as if fully set forth in this specification.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

We claim:

1. A cleaning, passivating, and lubricating solution comprising:

an alcohol in an amount ranging from 20 to 40 percent by volume;

a fatty acid in an amount ranging from 20 to 40 percent by volume; and an oxidizing agent in an amount ranging from 20 to 40 percent by volume.

2. A cleaning, passivating, and lubricating solution comprising:

an isopropyl alcohol in an amount ranging from about 20 to about 40 percent by volume;

a vegetable oil in an amount ranging from about 20 to about 40 percent by volume; and a hydrogen peroxide in a solution of from about 1 to about 10 percent strength in an amount ranging from about 20 to about 40 percent by volume.

* * * * *